United States Patent [19]

Null

[11] 4,149,166

[45] Apr. 10, 1979

Best Available Copy

[54] DOPPLER COUNTERMEASURE DEVICE

[75] Inventor: Fay E. Null, Shalimar, Fla.

[73] Assignee: The United States of America as represented by the Secretary of the Air Force, Washington, D.C.

[21] Appl. No.: 108,960

[22] Filed: May 9, 1961

[51] Int. Cl.[2] ..... F42B 13/56

[52] U.S. Cl. ..... 343/18 E; 102/89 R; 102/89 CD; 244/3.27

[58] Field of Search ..... 343/18, 18 E; 244/14, 244/3.1, 3.27; 102/63, 89 R, 89 CD

[56] References Cited

U.S. PATENT DOCUMENTS 3,568,191 3/1971 Hiester ..... 343/18 E

*Primary Examiner*—Verlin R. Pendegrass

*Attorney, Agent, or Firm*—Joseph E. Rusz; Sherman H. Goldman

EXEMPLARY CLAIM

1. A Doppler decoy protection device comprising a missile capable of being launched from a space craft whose protection is sought, and to travel in advance thereof and at a speed greater than the speed of said space craft, guide means extendable rearwardly from said missile, Doppler decoy means slidable on said guide means for simulating the Doppler characteristics of the craft whose protection is sought, means for damping the speed of travel of said decoy means rearwardly on said guide means so that the resultant forward speed of said decoy means will substantially equal the speed of the craft whose protection is sought.

34 Claims, 26 Drawing Figures

INVENTOR.
FAY E. NULL

BY Wade Koontz and Ruth Cadier

Fig-4
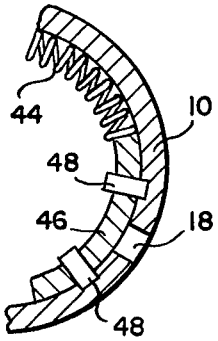
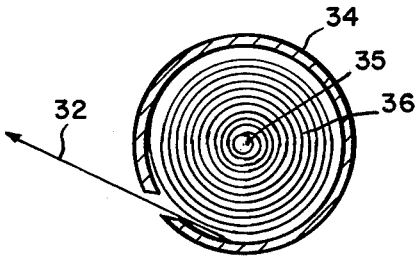
Fig-6
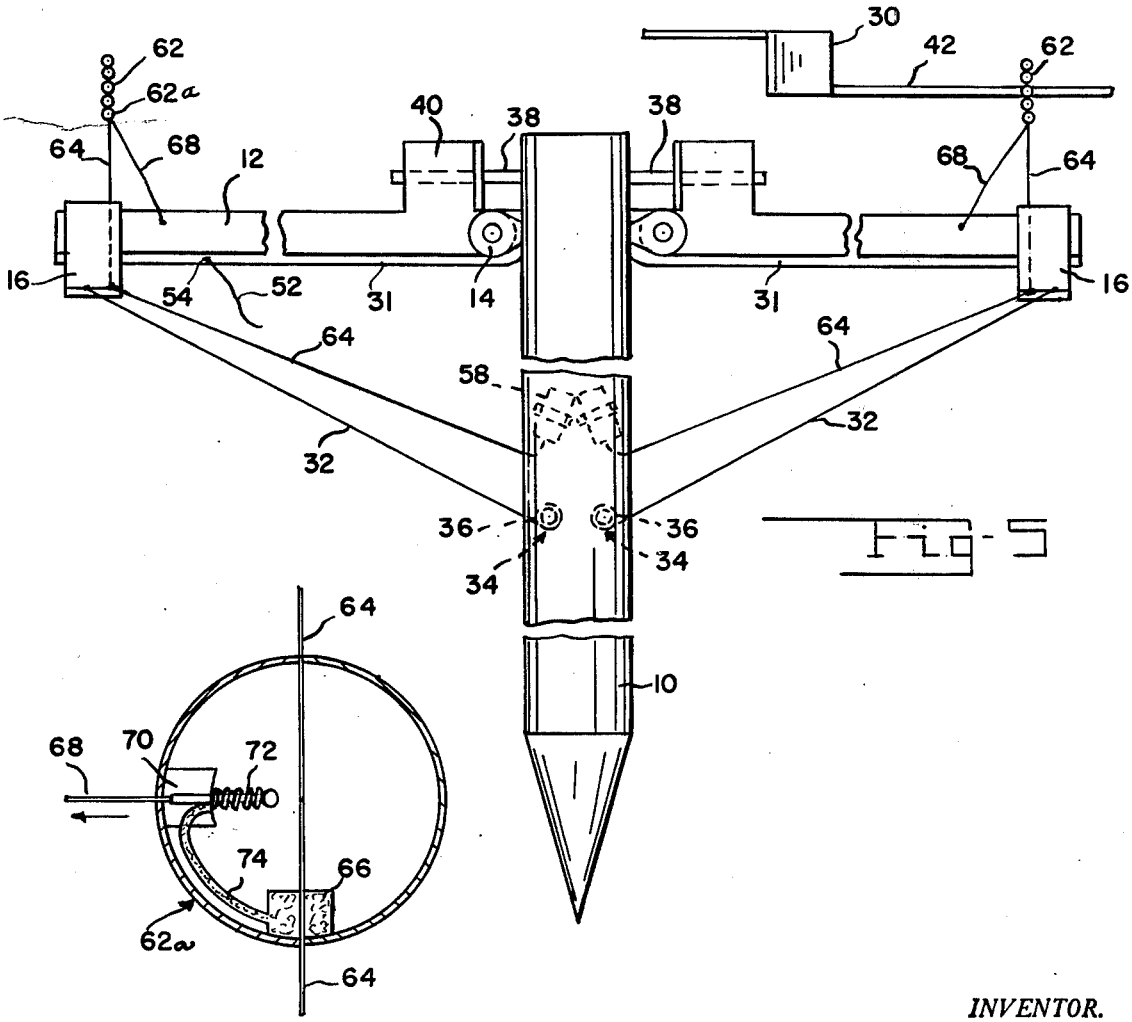
Fig-5
Fig-7
INVENTOR.
FAY E. NULL
BY Walter Kourt
Ruth Codiero
ATTORNEYS

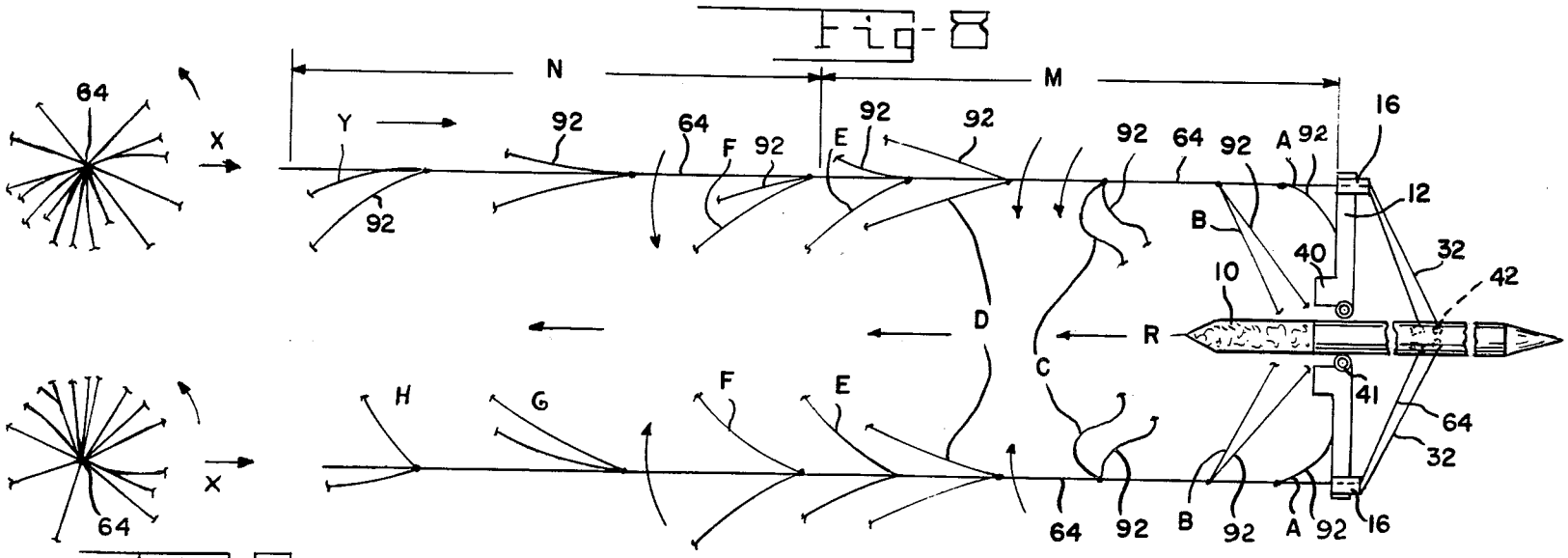
Fig-10
Fig-10a
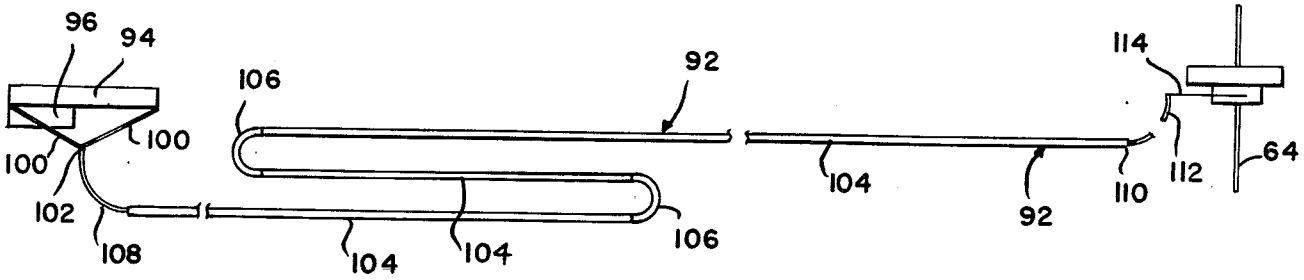
Fig-11
INVENTOR.
FAY E. NULL
BY Wade Lovett
Ruth Codier
ATTORNEYS

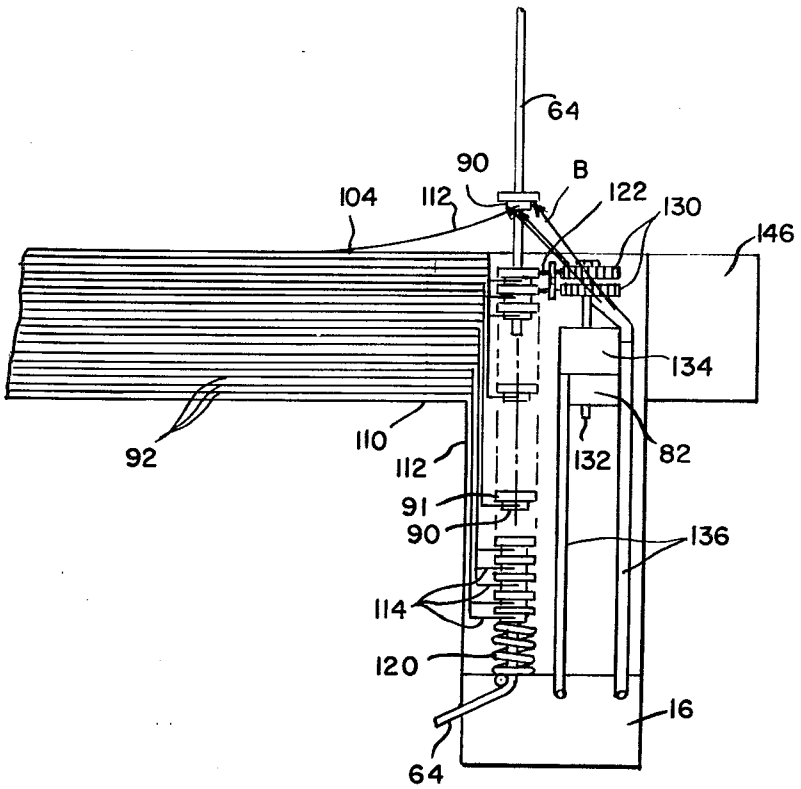
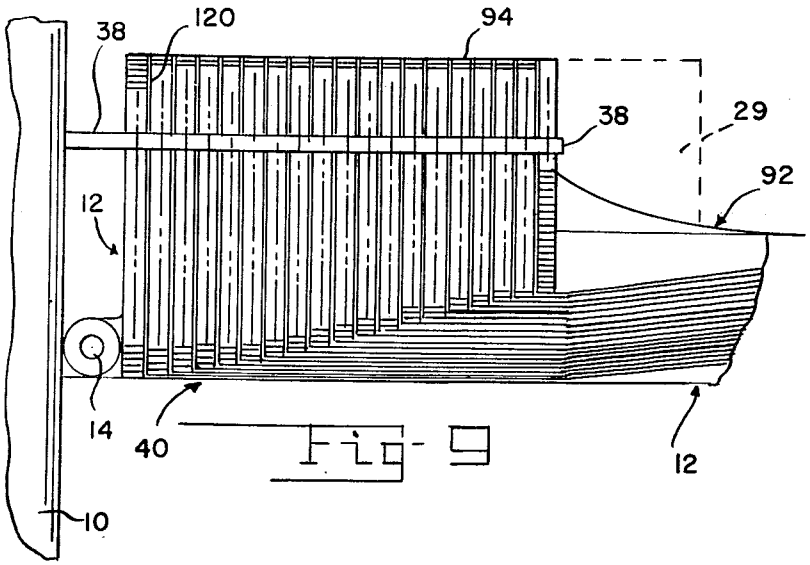
FIG. 5
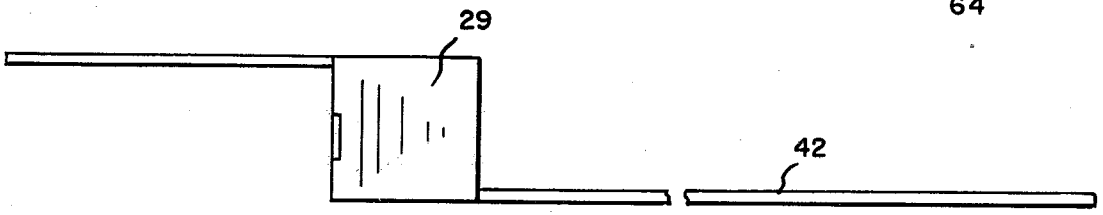
FIG. 10
INVENTOR.
FAY E. NULL
BY
Wade Lowry
Ruth Cordiello
ATTORNEYS INVENTOR.
FAY E. NULL
BY Wade Koontz Jr.
Ruth Codier
ATTORNEYS

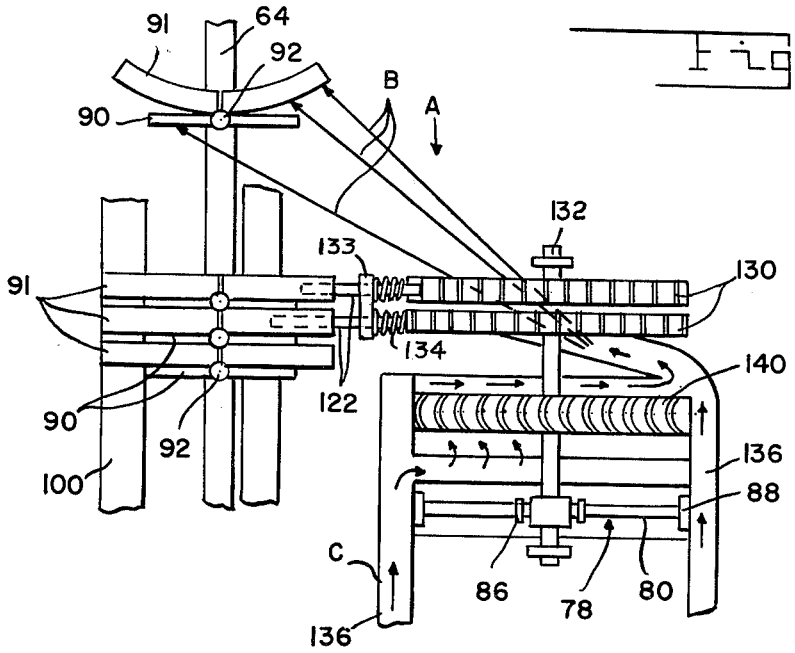
Fig-14
Fig-18
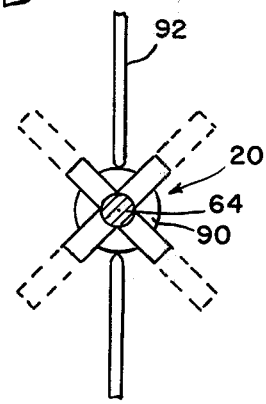
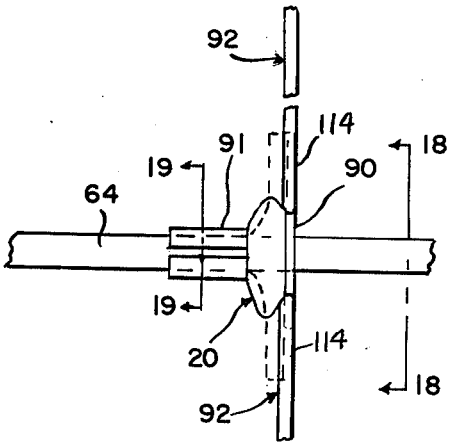
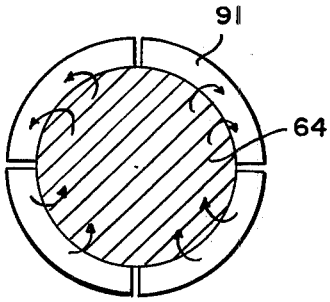
Fig-19
Fig-17
INVENTOR.
FAY E. NULL
BY Wade Crowley and Ruth Codier
ATTORNEYS

INVENTOR.
FAY E. NULL

BY

Warren Coombs
Ruth Cadieux
ATTORNEYS

INVENTOR.
FAY E. NULL

BY Wade Lowry
Ruth Codier
ATTORNEYS

DOPPLER COUNTERMEASURE DEVICE

The invention described herein may be manufactured and used by or for the U.S. Government for governmental purposes without payment to me of any royalty thereon.

This invention relates to Doppler countermeasures and, more particularly, to a slide wire decoy sent ahead and simulating the speed of a bomber or other vulnerable aircraft target for decoying the position of the target and drawing enemy fire to itself.

The invention was conceived as an answer to the enemy Doppler seeker than can discriminate against the usual chaff which immediately looses its forward velocity when it is dropped from a moving aircraft vehicle. The invention incorporates appropriate resonant lengths of antennas which are electroplated on insulator fibers. The fiber antennas are secured to carrier rings, are threaded onto and slide on steel guide wires trailing from projected arms on a decoy rocket which has been sent ahead of the bomber or other target whose protection is sought. These guide wires are magnetized by sections and a braking action is effected between the minute slide carriages carrying the antennas, and iron foil flaps attached to the carriages. Sufficient magnetic friction is produced in this manner to slow down the velocity of the fibers in their travel backward along the steel guide wires and their velocity relative to the earth is thus diminished. It will thus be seen that a decoy is effected which simulates the velocity of the vulnerable target which it seeks to protect. Enemy missle seekers cannot use the Doppler principle to discriminate between these fiber supported antennas.

Randomness and decoy reflection waves of both horizontal and vertical polarization components are produced as follows: Small sail foils on the ends of these fibers hold them out at an angle to the slide wires and produce a spiralling motion around the guide wires. Sophisticated enemy seekers are prevented from discriminating between the decoy signals on the basis of an excessive polarization in either of the horizontal or vertical components. The sails also impart a spiral motion about the guide wires which produce a randomness to the phase addition of the individual electroplated decoy antenna dipoles, preventing the composite decoy antenna or radiation pattern from having noticeable holes for an appreciable time interval in the direction of the enemy missile.

The flow of slide wire decoys can be properly regulated over the desired time interval by means of a simple cam escapement controlling a column of slide wire carriages prethreaded on the guide wires. The guide arms are made very thin and supersonically streamlined for low drag. They are foldable for stowing and launching.

Background: The effectiveness of the bomber defense may well determine whether our strategic hydrogen bomb reprisal threat is feared by the enemy, or whether he considers it an empty shell in the face of his well-conceived preparations for defense in depth. Enemy fighters may be vectored in for launching of missiles with nuclear warheads from any angle of attack. These nuclear warheads may cause severe gamma ray damage to the bomber crew at high altitude if they detonate within about one and one-half miles of the bomber. Since high velocity missiles cannot vary their course very much, once comitted to a collision course, it is imperative to launch defense missiles fast enough to intercept the enemy missiles at least one and one-half miles from the bomber.

This requires a defense decoy missile to have a speed much greater than that of the bomber from which it was launched. Or, if the decoy missile is to deceive the fighter into launching a missile in its direction, it must be over one and one-half miles from the bomber position when the enemy missile is launched. This again requires, in general, a much higher velocity for the decoy missile than that of the bomber. Any towed antennas from such a high speed decoy missile could be discriminated against by an enemy missile seeker using Doppler detection, since the Doppler frequency from the decoy would be much higher than that from the bomber. Chaff, on the other hand, would reach a very low velocity almost immediately upon leaving the vehicle. The decoy, to be effective, must therefore have a ground velocity about equal to that of the bomber. The correct velocity for a slide wire decoy antenna can be obtained by allowing the slide decoy to rapidly decelerate in the slip stream until it has reached the desired ground velocity; the friction on the guide wire being calculated to just equal the drag at this velocity, so that the slide decoy remains at this velocity during the remainder of its passage over the guide wire. Other means can conceivably be used to produce friction. However, a relatively large force of friction with a small area of slide contact is effected by using an iron foil carriage to support the slide decoy antenna on a magnetized guide wire. To prevent the slide decoys from sliding out over the guide wires with a poor time distribution, a simple escapement type release has been utilized.

In the drawing,

FIG. 4 is a fragmentary cross-sectional view taken through the rocket wall to show closing of the arm-receiving slit opening in the rocket wall after the arms have been extended.

FIG. 5 is a schematic top plan view of the missile after the arms have been extended.

FIG. 6 is a cross-sectional view of one of the coil springs controlling the guy wires which support the extended arms.

FIG. 7 is a cross-sectional view of a ball element carrying an explosive, one such ball being located near the end of each guide wire.

FIG. 8 is a schematic top plan view of the decoy missile or rocket with the arms and guide wires extended and showing decoys sliding rearwardly on the guide wires.

FIG. 8*a* is a schematic end view looking in the direction of the arrow X of FIG. 8.

FIG. 9 is a schematic top fragmentary view of one extended arm with the top wall of the arm removed to show the method of storing sails and antennas, of threading the slide carriages on the guide wire and showing also the escapement device.

FIG. 10 is a top plan view of the forward wall of an arm after its removal for allowing escape of the antennas.

FIG. 11 is a broken view of a complete antenna length and its appended sail, its flexible joints and its flexible steel end connections.

Figure 12:
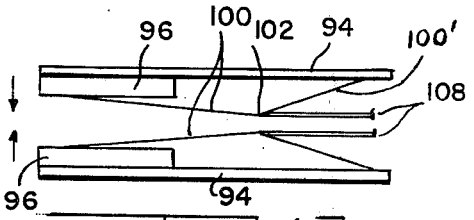

FIG. 12 is an enlarged schematic side view of two adjacent sails, one sail inverted to show the method of stacking in nested position.

Figure 13:
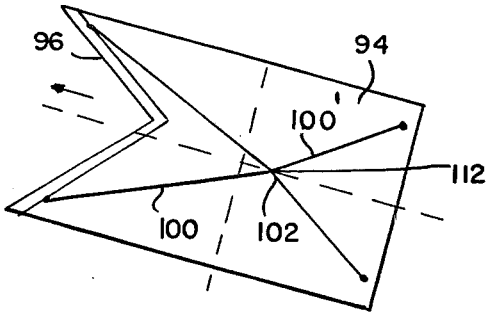

FIG. 13 is a view of a single sail and support.

FIG. 14 is a schematic top view of the storage and ejection system devised for sending the decoy units out onto the guide wires in controlled sequence.

Figure 15:
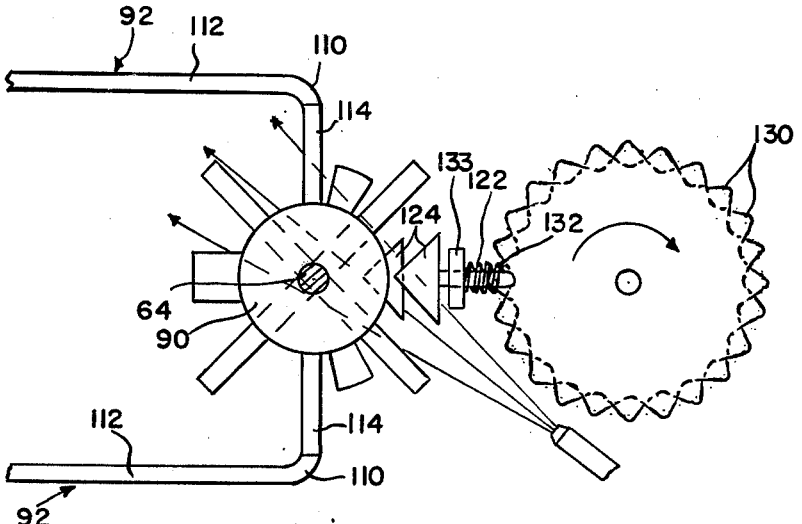

FIG. 15 is a schematic view of the ejection system looking in the direction of the arrow A in FIG. 14.

Figure 16:
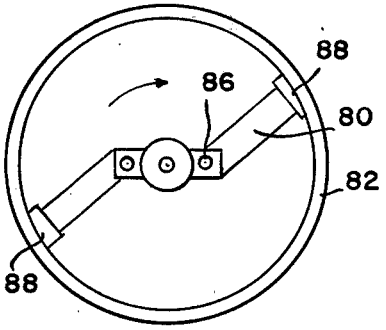

FIG. 16 is a schematic view of the frictional centrifugal brake element which controls the ejection system.

FIG. 17 is a schematic side view of a slide carriage showing its attached antennas and brake flaps.

FIG. 18 is a sectional view taken on the line 18—18 of FIG. 17.

FIG. 19 is a cross-sectional view, taken substantially on the line 19—19 of FIG. 18, much enlarged for showing the operation of the magnetic brake.

Figure 20:
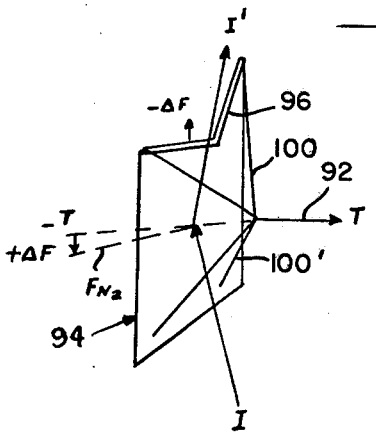

FIG. 20 is a schematic view of a sail and sail supports.

Figure 20A:
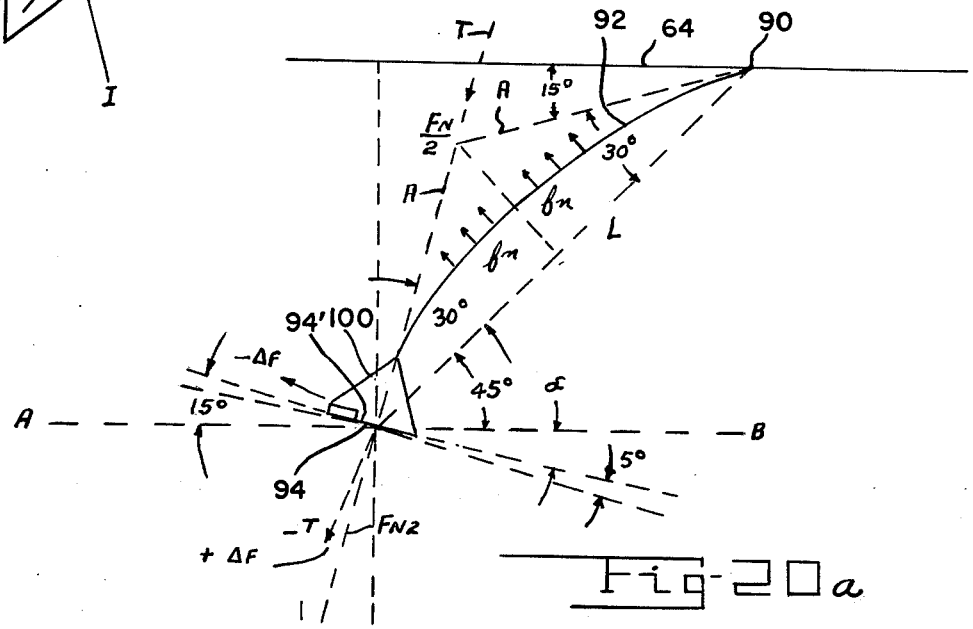

FIG. 20*a* is a schematic view showing a slide carriage and an antenna and sail support in equilibrium position.

Figure 20B:
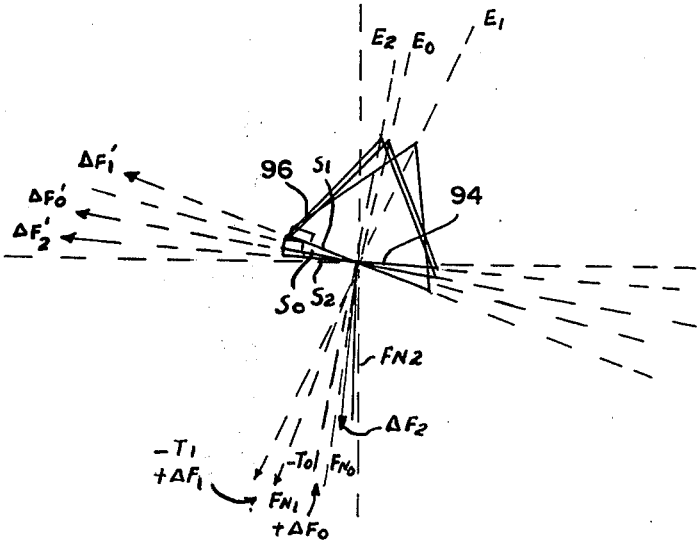

FIG. 20*b* is a schematic view of an antenna and sail showing perturbations from equilibrium position, and the compensative force afforded by the vane appended to the sail.

Figure 21A:
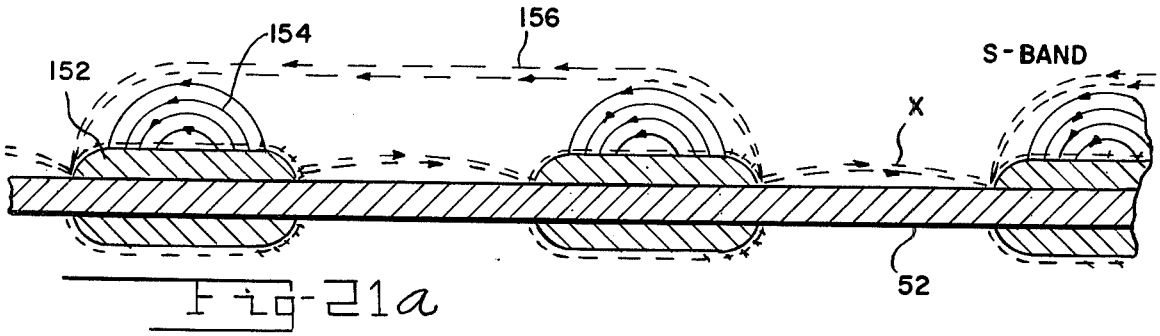
Figure 21B:
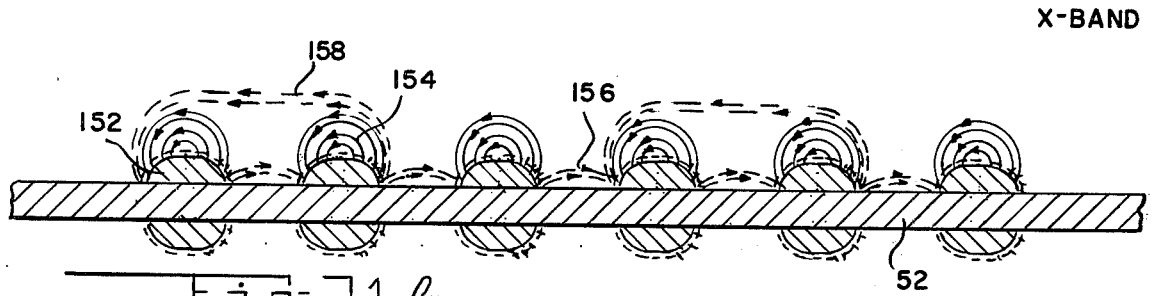
Figure 21C:
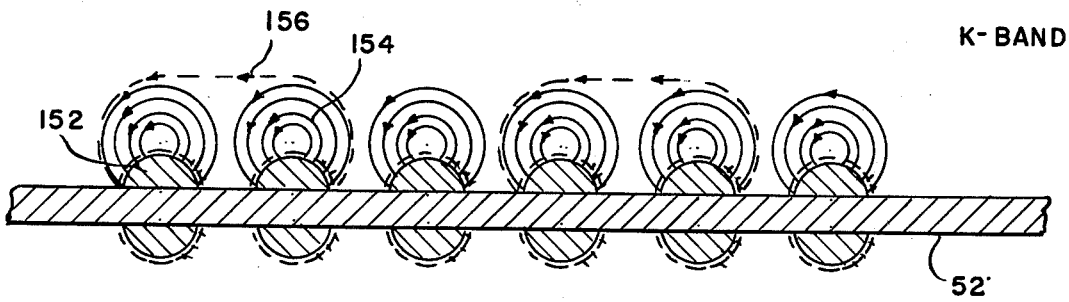

FIGS. 21*a*, 21*b*, 21*c* show the respective distribution of the dipoles on the antennas for each of the bands S, X and K.

It will be understood that the parts of this device are minute, that the illustrations in the drawings are schematic and in most of the figures the elements are greatly enlarged. For a better understanding of the relationships involved, the following dimensions are given as exemplary only, it being understood that they may be modified within the scope of the invention.

The guide wire designated 56 in the drawing is 0.256 inches in diameter and possesses tensile strength of 200,000 lb/sq in.

The antennas 64 are No. 40 wire or 0.00314" in diameter.

Metal end sections 114 may be 8" long.

Length of slide decoy antenna 8.23'.

Thickness of copper dipole deposit 0.001".

Diameter of missile 7".

Thickness of arms ½".

Length of each arm 16, 10".

Width of arm 4".

Sail area 0.50 sq in.

It will be understood that the invention is by no means limited to any one or all of these specific dimensions.

Referring more in detail to the drawing, a missile or rocket body is represented by the numeral 10. A series of these elements may be stored in the body of a bomber or other vulnerable object which it is intended to protect. They are sent forward from the bomber to simulate Doppler frequencies of the bomber itself, and at safe distances from the bomber in the event the decoy missile is hit.

Figure 1:
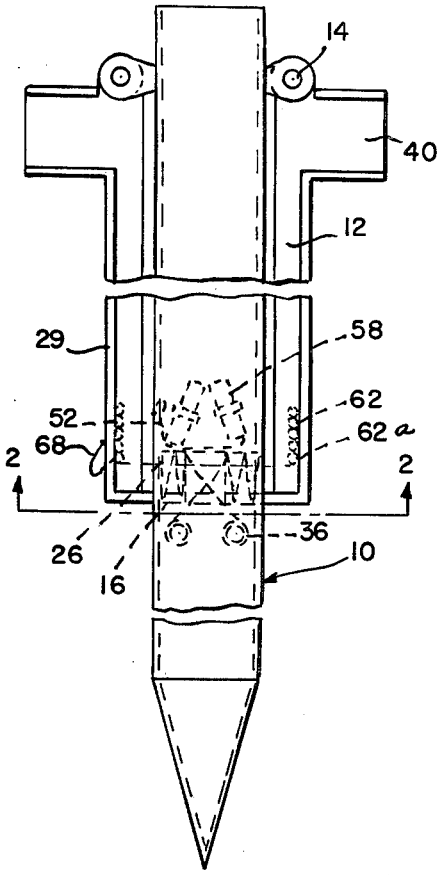
FIG. 1 is a schematic top plan view of the missile or rocket decoy with the arms folded and before launch, showing some internal parts of the device in phantom.
Figure 2:
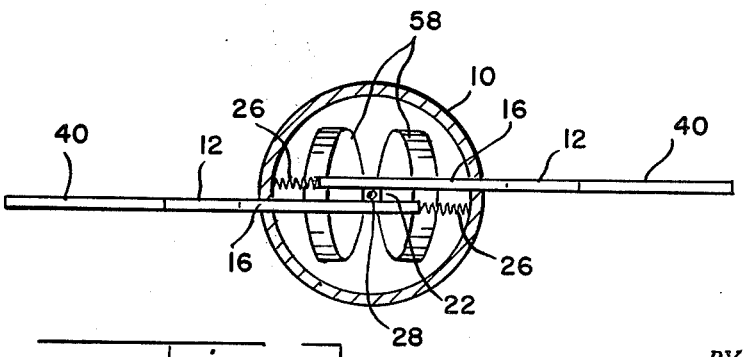
FIG. 2 is a twice enlarged cross section on the line 2—2 of FIG. 1, with the arms 12 in closed position.

A pair of arms 12 are pivoted to the missile body 10 as shown at 14. In stowage of the missile, and in its initial flight from the bomber or other vulnerable target, the arms 12 are folded parallel to the body 10. The ends 16 of the arms 12 extend normally thereto and provide housings for the antenna ejector system (later described). The ends or housings 16, when folded, extend into slots 18 (see FIG. 4) provided therefor in opposed positions in the body 10 (FIGS. 1 and 2). The ends pass each other and overlap. The overlapping ends or housings 16 are held engaged during storage by a detent 22. They are thrown outward by the compressed springs 26 when the detent 22 is released by the firing of a primer charge 28. The firing of this charge is controlled as necessary by the arming fuse for the missile.

The arms 12 are relatively very thin. For a seven-inch diameter missile, the arms are only one-half inch in thickness and are provided with wedge-shaped leading edges for aerodynamic low drag wherever possible (see 29, FIG. 1; 30 and 31, FIG. 5).

As the arms 12 are thrown out by the force of the springs 26, they are caught by the slip stream and rapidly forced into the open position shown in FIG. 5, which is a 90° position with reference to the missile axis. The brace or guy wires 32, secured each to a member 16, brake the movement of the arms 12 as they unwind from the spools 34 and wind up the strong torsion spring 36 (see FIGS. 1 and 6).

As the arms 12 reach the extended 90° position, the rods 38 (see FIGS. 5 and 9) mounted in housings 40 and protruding therefrom, impinge upon the missile body 10, providing the thrust necessary to knock off the rear wall 42 of the arm 12 (see FIGS. 5, 9 and 10). This leaves the rear wall of each arm open for the unimpeded escape of the individual decoy decoy antennas (later described).

As noted, the ends 16 of the arms 12 enter slots 18 in the missile body 10. For reducing drag, the slots 18 left open by the removal of the arm ends, are now closed by springs 44, which drive shields 46 over the slots 18, where they are locked in place by lugs 48 (see FIG. 4).

Figure 3:
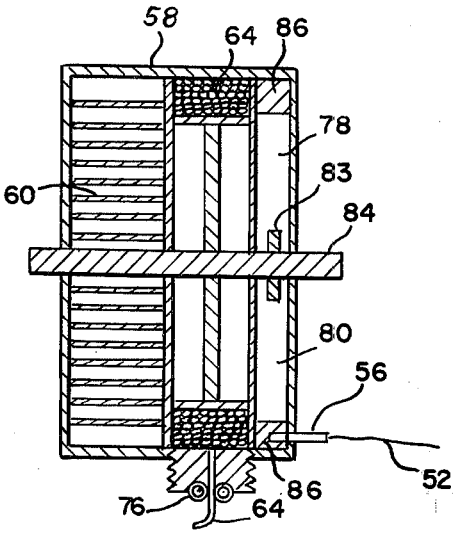
FIG. 3 is a cross-sectional view of one of the spring loaded wheels from which the guide wires are unwound.

A cord 52 (FIGS. 1, 3 and 5) is attached at one end to the inner edge of the arm 12 at 54 and at the other end to a detent 56 (see FIG. 3). The detent 56 holds the spool 58 against rotation. Although only one such mechanism is here described, it will be understood that the spool and detent device is duplicated for each arm. As the arms 12 sweep rearwardly toward the 90° position, the detents 56 are removed, the spools spin under the action of the strong torsion spring 60 which has been held under compression. As the arms 12 are brought to a rapid stop, the balls 62 threaded onto the ends of the pair of guide wires 64, are thrown out into the slip stream and, by means of their drag force, tow the guide wires after them. Since part of the lengths of guide wires 64 are magnetized, it requires a greater force to unwind them than can be conveniently attained from the inertia of balls 62. This additional force is supplied by the torsion springs 60.

To prevent the stacking up of the slide carriages, later described, the balls are blown off the ends of the wires when the wires have reached their full extension. This is done by providing one of the balls on each wire, indicated for convenience as 62*a*, with a detonating charge 66 for breaking the guide wires 64, freeing the balls which fall away, leaving the wire ends free for the escape of the antenna carriages. For this purpose, a cord 68 (see FIGS. 1, 5 and 7) is attached to the trailing edge of each of the arms 12 and to a match or other ignition device 70 located within the ball 62*a*. As the cord 68 is pulled out of the ball 62*a*, a match 70 is pulled down against the spring 72, igniting the powder train 74 leading to the charge 66. The wire 64 is broken by the explosion of the charge. The balls fall away leaving the ends of the guide wires free. If the balls were not freed, the wires 64 would be unable to sustain a 3,000 pound per second change in velocity, inflicted by the slide decoys stacking up against them. (In their travel along the wire 64, the velocity of the decoys becomes of the order of 2,000 feet per second relative to the ground; the velocity of the missile is of the order of 5,000 feet per second.)

Since sections of the guide wire 64 are magnetized and adjacent portions of magnetized wire present attraction or repulsion, some means is necessary to prevent kinking. A pair of pulleys 76 (FIG. 3), resiliently mounted, aid the smooth unwinding of the wire 64. The springs 60 provide additional power. As the springs 60 urge the wires 64 off the reel, its speed is braked by a centrifugal friction regulator brake 78. The regulator 78 can be of any desired construction. The type shown in FIG. 16 and used with the antenna ejection system (later described) can be used here. A pair of radially extending arms 80 of longer length than a radius of the drum 82 are pivoted to the center axle at 86, and are provided with brake shoes 88. As rotation increases in speed, the shoes 88 are thrown outward against the drum 82 with increasing braking pressure.

The wires 64 are pulled out through the decoy units 20, which have been threaded thereon and stacked within the housings 16 (see FIGS. 9, 14, 17 and 18).

Referring to FIG. 8, the arms 12 are extended and the guide wires 64 have been reeled out to their full length. The decoys 20 have been released into the drag of the slip stream.

Each decoy unit comprises a slide carriage 90, a ring element through which the wire 64 has been prethreaded, a pair of brake flaps 91 and a pair of antenna members 92 (see FIG. 17). The brake flaps 91 clamp down onto the magnetized portions of the wire 64, forming magnetic brake devices for governing the velocity of travel of the decay units rearward along the wires 64. Each antenna is equipped with a sail element 94, described later in detail. FIG. 8 shows schematically eight decoys and their positions and direction of movement at a selected moment. It will be remembered that the decoys are moving rearwardly along the wire 64, and that a decoy, for example in B position, will rapidly move to the D position while another decoy, at the moment in the A position, will take its place. That is to say, although FIG. 8 shows eight decoys on each wire, it also shows the sequence of motion through which a single decoy might travel. At the position shown at A in FIG. 8, a pair of slide decoy units have been blown out of the casing 16, the antennas are coming out of the arms 12 and the sails have not yet emerged. At B, two slide decoys with their antennas have been blown completely out of the arms 12; and at C, the sails have been exposed to the slip stream. At D, the sails have been caught by the slip stream and have been swept straight back past the rocket plume. (A rocket at supersonic speeds does not have a plume of appreciably greater diameter than the rocket body for the short hot part of the plume.) At E, the decoy units have decelerated and been extended by sails 94, and have started to rotate about the guide wires 64. At F, this deceleration and rotation have been continued until at G, a distance of 42 feet in the example given, the ground velocity has dropped from $V_o$, that of the rocket, say 5,000 feet per second, to $V_1$, the velocity of the bomber at perhaps 2,000 feet per second. For the remainder of the 100 feet of wire length, the velocity of the decoys simulates that of the bomber.

The sails and decoys are minute. For slide decoys of about $3.62 \times 10^{-3}$ inch diameter, 8.23 ft. length, and with sails of 0.50 square inch area, the velocity of 2,000 feet per second will be reached in 42 feet at an altitude of 50,000 feet.

FIG. 8 shows the deceleration area indicated at M, which in the example given is 42 feet. At F, G and H etc and the remaining length of the wire, indicated at N, i.e., the remaining 100 feet of wire in the example given, it is desired to hold the velocity of the slide decoys at 2,000 feet per second while they describe the spiral motion indicated in FIG. 8*a*. To keep the acceleration of the slide decoys zero over this 100′ length of guide wire, the guide wires are magnetized in this area so that there will be sufficient friction between the slide carriages 90, at F, G and H and the guide wires to equal the 1.52 lb of drag force produced on the pair of slide decoys and their associated sails. This is done by means of the magnetic braking device later described. It takes 0.05 second for a slide decoy pair at 2,000 feet per second to pass over the 100 feet of guide wire. If 47.6 pairs of slide decoys are required at one time, this gives a drag load on the guide wires of $47.6 \times 1.52 = 72.5$ lb. For a 1.4 safety factor, this indicates a required strength of guide wire of 101 pounds, and an 0.0256 inch diameter guide wire for a tensile strength of 200,000 pound per square inch, which is readily obtained in this size of steel wire.

Each sail 94 is provided with a flange or vane element 96 (see FIG. 12) which extends at right angles to the body of the sail, and extends assymetrically along an angular off-center V-cut located in one end of the body of the sail. The vane 96 is calculated to keep the sail 94 from erratic lateral swings while producing a rotation of the ring or slide carriage 90 with respect to the guide wires 64. The vane 96 gives dihedral effect in the horizontal plane, and keeps the sail headed into the relative wind. The vertex of the vane 96 is slightly off-set from the center to give the sail element an angle of yaw that will cause it to spiral around the guide wire 64.

Each sail is provided with a set of attachment lines or guy wires 100 and 100′, four as shown in FIGS. 12, 13 and 14. The attachment lines merge at a point 102 and are secured to the antenna member 92 through a flexible metal segment 108. The rear attachment lines 100 are longer than the forward lines 100′. This arrangement throws the normal aerodynamic force forward and compensates for the negative tension vector in the antenna and slide carriage and produces a forward force component. The vanes, providing a dihedral effect, balance this forward force component and keep the sail headed into the relative wind. The assymetry in the vertex position of the vane produces a yaw and spiralling of the antenna and sail around the guide wire. Since the decoy antennas are longer than the length of the arm 12, it will be necessary that one section at least of antenna be flexible and capable of being folded. The main length of the antenna is glass fiber, sections 104 of which are shown in FIG. 11 connected by flexible metal joints 106. The glass fibers and connecting wires are so fine that a fused junction between metal and glass will not produce breakage due to any difference in coefficient of expansion. Experience has shown that sealing a metal foil, such as copper, directly to glass can be done without danger of breakage. The guy wires 100 and 100′ of the sails are drawn together and fused to steel wires 108. At the opposite end at 110 (See FIGS. 9, 11 and 15) the glass fibers are fused to the flexible metal wires 112, which in turn, are welded to the steel spokes 114 by means of which the antenna is secured to the slide carriage 90.

The manner in which the sails are stacked in the housing 40 provided at the inner or pivot end of the arm 12, is shown in detail in FIGS. 9 and 12. As shown in FIG. 12, the position of alternate sails is reversed so that the vanes 96 of one sail will nest with the vane 96 of an adjacent sail. The guy wires or attaching lines 100 lie between the sails. The sails are stacked in this manner in ordered vertical stacks beginning at the entreme left side of the compartment 40, as shown in FIG. 9 with the antennas first threaded on the guide wires 64. The flexible wires 108 are drawn together into the area or aisles directly to the right of the stack and are conducted downwardly as the height of the stack requires. The antennas, attached to the flexible wires are drawn out to the right and their excessive length is taken up by folding as above described. The metal end sections 108 may be up to eight inches in length depending upon the position in which they are to be packed.

A partition or any sort of a guide or separating member 120 is then placed to the right of the stack serving as a guide and temporary wall for aiding in stacking. The second stack of sails is arranged as the first. The partitions are removed after the stacking has been completed and their purpose has been served. In FIG. 9 no attempt has been made to show all of the antenna members 92, sails 94, and attaching wires 108. It is to be remembered that in a completed device there may be, for example, 1,820 carriages per arm which would mean twice that number of antennas and sails.

The escapement mechanism which expels the antennas out into the slip stream will now be described. As before stated, the glass fiber sections 104 of the antennas 92 are fused to the flexible metal wires 112 which are welded to steel spokes 114, in turn welded or otherwise secured to the carriages 90. The carriages 90, with their appended brake flaps 91 and antennas 92, are threaded onto the guide wires 64. (FIGS. 9, 14, 15, 17 and 18.) A spring 120 is compressed as the decoy elements are threaded onto the wire 64, exerting a pressure forward on the whole stack of elements thus urging the forward decoy into escapement position. The spring 120 has a fine wire diameter compared to its extended pitch so that it is capable of supplying pressure all the way to the escapement.

A pair of reciprocating plungers or pins 122, provided with triangular heads 124, alternately serve the function of holding the stack in place against the bias of the spring 120, which urges the stack rearward. When the second pin holds the stack, the rear pin is withdrawn, allowing the rearward decoy unit to escape. When the second pin is withdrawn and the rear pin holds the stack, the whole stack moves rearward, and another decoy unit is pushed into the rearward position, where it can escape as soon as the rearward pin has been again withdrawn. This operation is effected by means of a pair of cam wheels 130 mounted on a common shaft 132 and provided with offset troughs and crests. The pins 122 are biased into the troughs of the cams by the springs 134. The springs 134 are seated at one end on stationary collar 133, through which the pins slide and are secured at the other end to the pin itself.

The decoy units, released one by one in controlled time sequence, are blasted out into the slip stream by a blast of ram air indicated by the arrows B in FIGS. 9 and 14. The blast, introduced through the ducts 136, kicks the decoys out one by one as they are released by the cam-operated plungers 122, to slide on the guide wires 64, where they are caught by the slip stream.

The cam wheels 130 are mounted on a shaft 132 and are rotated by means of a turbine 140 which in turn is also actuated by the ram blast conducted to it through the ducts 136 and indicated at C in FIG. 14.

Attached also to the shaft 132 is the centrifugal regulator or friction brake 78, which may be of the type previously described and which regulates the rotation of the escapement cams to a constant speed. The escape of the decoys thus proceeds in controlled sequence.

FIGS. 20, 20*a* and 20*b* illustrate the functions performed by the antenna sails and the vanes provided for the sails. The following example is given for illustrative purposes only and it is to be understood that the conditions described herein are variable, within the scope of the invention. FIG. 20*a* illustrates a side view of a slide decoy with its attached antenna sail and vane, held in the equilibrium position necessary to produce about equal horizontal and vertical polarization of the signals received and returned by the dipoles (later described) which are electroplated on the glass fiber antennas. The slide carriage 90 is in the position of sliding out over the guide wire 64. The attached decoy antenna 92, attached to the sail 94 at the other end is held in the proper equilibrium position referred to above.

The actual size of the sail 94, the length and relative length of the support wires 100, 100′ and the position and size of the vane are the considerations which will determine the position of the antenna with respect to the guide wire, effect its spiralling about the guide wire 64 and effect the character of the radar signals accepted and returned. The size of the sail 94 is exaggerated for clarity. The antenna 92 is the diameter of number 40 wire which is 0.00314 inches. As described above, it consists of glass fiber except for the flexible joints and the lengths of steel wire attached to each end to provide better bending and storing capability. Too close proximity of the dipoles to the guide wire 64 would interfere with the proper resonant frequency due to the extra induced capacity. The metal ends 108 serve also to provide the separation necessary. These metal end sections may be up to eight inches in length depending upon the position in which they are stored in the guide arms 12. The drag force on the carriage 90 at 2,000 feet per second and 50,000 feet altitude was determined at 1.52 pounds or 0.76 pounds per slide decoy antenna (2 antennas per slide).

Referring again to FIG. 20*a*, the dotted line L represents a line joining the end points of an antenna 92 in a curved position such that the line L is at a 45° angle to the guide wire 64. The tangent to the antenna 92 at its ends is represented at A and lies at an angle of 30° to the line L and 15° to the guide 64. The tension T or drag force of the antenna and slide, whose direction is indicated by the arrow T in FIG. 20*a* can be calculated through the cosine of 15°. Tensile strength of about 126,000 pounds per square inch, in both the glass fiber and the steel ends of the antennas, is found to be the requirement. Glass fiber will qualify, since it has a tensile strength of 200,000 pounds per square inch. The aerodynamic normal forces per unit length of the antenna 92 indicated by $f_N$, in general, have only a small angle to line L and add roughly algebraically to give $F_N$, the negative tension vector of the antenna and slide unit. $F_N/2 = T \sin 30$ can also be used to give the tension T.

In the above given case, $F_N = 0.97$ pound for a slide decoy of about 8.23 feet in length. If, as at 94' the sail were perpendicular to the tension T, line A, it would have an angle of attack $\alpha$ and equals 10°. Its size could be adjusted to make the normal downward force on its surface equal to a $-T$. This would be an equilibrium position for the slide decoy antenna 92 and sail 94 if there were no drag force parallel to the sail. Actually, the sail 94 would swing the end of the antenna 92 upward towards the slide wire 64. To obtain a true equilibrium, the sail supports 100 are made of such lengths that the sail 94 is rotated 5° counterclockwise from its position at 94', giving it an angle of attack $\alpha = 10°$ and rotating the downward normal force 5° to the right of $-T$ at $F_{N2}$, giving a component of force $+\Delta F$, parallel to the sail 94 and tending to swing the sail antenna farther away from the guide wire 64.

To compensate, the small vane 96 is added to the sail 94 to produce a clockwise force $-\Delta F$ equal and opposite to $\Delta F$ at the given position of the sail and the slide decoy. It is necessary to correct the sail area for a small loss in lift due to vane 96, and to correct the relative lengths of the supports 100 for the small shift in the position of normal force on sail 94 due to the presence of the vane 96.

FIGS. 20, 20*a* and 20*b* illustrate the effect of the addition of the vane. In FIG. 20 the incident air flow I is reflected at I' producing the normal force $F_{N2}$. As before stated, the rear sail supports or connecting lines 100 are made longer than the forward ones at 100', so that $F_{N2}$ is rotated ahead of $-T$ with the component $+\Delta F$ parallel to the sail surface. Vane 96 is calculated to produce an equal and opposite force $-\Delta F$ for the given position. To keep the sail 94 from erratic lateral swings, the vane 96 is added to the rear end with a V-shape to give dihedral effect in the horizontal plane, and to keep the sail headed into the relative wind. The vertex of the vane 96 is slightly offset from the median line to give the sail an angle of yaw that will cause it to spiral around guide wire 64.

An examination of FIG. 20*b* makes it evident that, when tested for perturbations from the chosen equilibrium position, there is a restricting force always toward the initial position. Take the initial position $E_o$ for the antenna 92, S' for the corresponding position of the sail with $+\Delta F_o$ equal to the force $-\Delta F_o'$ on the vane 96. Let the sail be tipped to the position $S_1$ (see FIG. 20*b*), and the corresponding position of the slide antenna, $E_1$. This increases the angle of attack of the sail and as the normal force on the sail increases as the square of the angle of attack $F_{N1}$ is appreciably larger than $F_{No}$, and there is the same angle between $-T_1$ and $F_{N1}$ as between $-T_o$ and $F_{No}$ as obtained by the fixed lengths of supports 100 and 100', $\Delta F_1$ shows a marked increase. On the other hand, the value of $\Delta F_1'$ is less than that of $\Delta F_o'$, since the component of incident air velocity parallel to the sail 94 and perpendicular to the vane 96 has decreased. The sail 94 and the decoy antenna 92 will return to their initial position. Consider a perturbation of the sail to $S_2$ and the slide decoy antenna to $S_2$. The angle of attack has now decreased and $+\Delta F_2$ will be appreciably smaller than $+\Delta F_o$. On the other hand, the component of the of the incident air velocity parallel to the surface of sail 94 and perpendicular to the vane 96 is increased so that again there is a restoring force toward the initial position.

It will be understood from the broad purposes stated, that the antenna provided on the slide decoys will be uniquely prepared for the reception and return of radar signals anticipated from the ground and that provision will be made for S, X and K bands. The glass fibers of the antennas have copper dipoles 150 deposited on their surfaces. The greatest penetration of the electromagnetic field occurs for the S band from which the penetration X is $4.8 \times 10^{-5}$ inches of copper. The copper deposits are represented schematically in FIGS. 21*a*, 21*b* and 21*c* for the S, X and K bands, respectively. In the drawing, the copper deposits 152 are greatly exaggerated in thickness for clarity. The glass fiber of the antenna 92 may be, for example, only $3.14 \times 10^{-3}$ inches in diameter, and 0.001" thickness of copper is more than that which is actually needed. Painting a very thin layer of graphite over the surface areas desired for the dipoles would permit electroplating to be used to deposit the required amount of copper or the copper deposit or dipole could be made by vacuum deposited through stencils. Each dipole 152 or area of copper deposit has distributed capacity symbolized by the lines of force 154. In addition, the lines of force 154 complete a capacity circuit indicated at 156 between adjacent dipoles, which produces some change in their resonant frequency. It is desired to reduce this capacity coupling to a minimum since the amount by which this capacity circuit is changed depends upon the relative phase of the voltages induced in the series components of the circuit, that is, in adjacent dipoles. The relative phase of the dipoles depends upon their special relationship to the incident radiation wavefront, and as this varies over a wide range, the effective capacitive energy storage of the dipoles would vary with corresponding changes in the resonance frequencies. By making the space between dipoles or copper deposit areas about one dipole in length, the additional capacity of a dipole, i.e., the increase in capacity due to the capacity coupling fields 156 and 158, is only of the order of 3%. By this arrangement, the change in resonant frequency or distortion thereof is reduced to a negligable quantity. As the resonant frequency varies as the square root of the capacity, the maximum change in frequency and wave length by variable capacity coupling is of the order of 1.5%. For an average change in resonant frequency of the dipole of 0.75%, the energy radiated by the dipole for the designed incident frequency, would be about 94% of the resonant value and not a serious drop.

For any vulnerable target, the number of slide decoys, and the dipole characteristics, i.e., S, X, or K bands, or combinations thereof can be calculated as necessary to effect the protection sought. The number of slide decoys which would be required at one time to duplicate the signals from a B-36, broadside view, for each of the bands S, X and K, have been estimated on the basis of one thousand dipoles. Experience has shown, however, that 850 dipoles will hide a B-36 broadside view. It is important to estimate how close our intelligence must come to an enemy seeker frequency in a given band, for decoys tuned to the center of the band to be effective. Consider the frequency ranges obtained by varying the frequency 50% up and 50% down from the center of the bands as follows:

| Band | Megacycles | Range in Megacycles |
|---|---|---|
| S | 3,000 | 1,500 |
| | | 4,500 |
| X | 9,000 | 4,500 |
| | | 13,500 |
| KK | 25,000 | 12,500 |
| | | 37,500 |

To form an estimate of the relative amounts of energy radiated for 50% off-resonant frequency consider a center feed antenna of one-half wave length. Let, $R_R$ = radiation resistance, r = thermal resistance, and R = total dipole resistance, X = antenna reactance, and Z = antenna impedance, and $e_i$ = voltage induced in dipole.

At resonance: $R_R = 65$ ohms, $r = 4.5$ ohms, and $X = 0$, and $Z = 69.5$ ohms

At frequency 50% below Resonance } $R_R = 350$ ohms, $r = 4.5$ ohms, and $X = 700$ ohms, $Z = 785$ ohms Or radiated energy, $i^2R_R \frac{e_i^2R_R}{Z^2}$ is about 42% of that for the center of the band, or a range (distance) 0.8 that of the center of the band.

At frequency 50% above Resonance } $R_R = 32$ ohms, $r = 4.5$ ohms, $X = -500$ ohms, $Z = 502$ ohms.

Or radiant energy is about 0.95% of that at the center of the band or a range (distance) 0.30 of that for the middle of the band. This would not be serious in the case of decoy missiles fired out upon the attacking missile path so as to cause the enemy missile to detonate at over 1½ miles from the bomber, e.g., in the case of reduction in maximum range to 0.30, a decoy at 3,000 feet would give the same sized blip as the bomber at 10,000 feet.

Where it is desired to use the slide decoys on a decoy, before an attacking fighter launches its missiles, the decoys would not in general have a distance advantage, and it would be necessary to consider use of a wider variety of resonant decoy frequencies. Thus, if 6 resonant decoy frequencies were used, each length of dipole would only need to accept frequencies varying by 25% from the resonant value. Thus, for a frequency 20% less than resonant value the energy radiated would be about 25.9% of the tuned value, and for a frequency 20% greater than the resonant value the energy radiated would be 29.0% of the tuned value. Introducing a second set of dipoles in the S band would give sufficient frequency coverage, as the X and K bands are roughly 3rd and 5th harmonics of the S band, and a multiple wave length, slide antenna decoy may, for example, be about as efficient as an isolated dipole in the intensity of radiation averaged over a hemisphere. (The randomness in direction of the dipole radiation is similar to that of chaff so that it is fairly homogenous in direction.) Taking advantage of the fact that 850 dipoles were found sufficient for duplication of a B-36 broadside blip rather than the 1,000 originally assumed in the calculations, the increased magnitude of slide decoys required to double the S band decoys would be $0.85 \times 1.61 = 1.36$. Or the blip for the resonant frequencies (2 for each band) would be $1/1.36 = 0.735$ as strong as before when a set of dipoles was used for each band. This would be equivalent to 0.922 of the former bomber range or 42.7° change from the broadside position. For incident frequencies ±20% from the resonant decoy frequencies the intensity of the blips would decrease to 0.735 for the resonant frequencies, times the off-resonance values of 0.259 and 0.29 found above, or $0.735 \times 0.259 = 0.191$, or $0.735 \times 0.290 = 0.214$ respectively, of former energy radiated for 3 sets of dipoles, with equivalent ranges of 0.66 and 0.68, and equivalent changes in aspect angle from the broadside position of 79° and 78.5° respectively. It does not appear, therefore, that the attacking fighter could readily discriminate between the blip due to the slide decoys and that due to a bomber.

It is to be understood that the specific embodiments and examples of the invention as described above, including specific dimensions of parts and the specific velocities are by way of example only, and that modifications within the scope of the appended claims may be made without departing from the spirit of the invention.

I claim:

1. A Doppler decoy protection device comprising a missile capable of being launched from a space craft whose protection is sought, and to travel in advance thereof and at a speed greater than the speed of said space craft, guide means extendable rearwardly from said missile, Doppler decoy means slidable on said guide means for simulating the Doppler characteristics of the craft whose protection is sought, means for damping the speed of travel of said decoy means rearwardly on said guide means so that the resultant forward speed of said decoy means will substantially equal the speed of the craft whose protection is sought.

2. A Doppler decoy protection device comprising, a decoy missile capable of being launched from a space craft whose protection is sought, arms on said missile extendable vertically to the axis of said missile, guide wires extendable rearwardly from said arms, magnetized areas on said wires, decoy units threaded on said guide wires and slidable thereon, escapement means to release said decoy units in controlled sequence, metal brake flaps on said decoy units to react with said magnetized areas on said guide wires for braking the rate of rearward travel of said decoys to obtain a velocity equal to that of the protected craft, and simulating the Doppler characteristics of said craft.

3. A Doppler countermeasure device comprising a decoy missile adapted to be launched from a space craft whose protection is sought, to travel at a speed greater than the speed of said space craft, said countermeasure device comprising a missile body, arms on said missile body extendable at approximate right angles thereto, housing units on the outer end of each of said arms and extending at right angles thereto, oppositely located slits in said missile body for receiving said housings in overlapped relation, an explosively releasable detent for holding said housings in overlapped locked relationship, compression springs of sufficient strength to propel said housings outwardly into the slip stream upon release of said detent, wires housed on reels located in said missile, weighted balls on the ends of said reels whereby said wires when released are reeled from said reels to trail behind said arms, a multiplicity of decoy units threaded onto each of said wires, means maintaining said threaded decoy units in stored and packed condition in said arms, means for effecting the escape of said decoy units at controlled time intervals for travel backward along said wires at controlled speeds so that the resultant forward speed of said decoy units simulates that of the space craft it seeks to protect.

4. In the device according to claim 3, means automatically operated for covering said slits to reduce drag after said arms have been extended.

5. A Doppler countermeasure device comprising a decoy missile adapted to be launched from a space craft whose protection is sought, to travel forward from said space craft at a speed greater than the speed of said space craft, said countermeasure device comprising a missile body, arms on said missile body extendable at approximate right angles thereto, housing units on the outer end of each of said arms and extending at right angles thereto, slits in said missile body for receiving said housings in overlapped relation, explosively releasable means for holding said housings in overlapped locked relationship, means for propelling said arms outward into the slip stream of said missile, guide wires capable of being unreeled to trail behind each of said arms, decoy units threaded on each of said wires, and stowed before launch of said missile in said housing units, means for effecting the escape of said decoy units at controlled time intervals for travel backward along said wires at controlled speeds so that the resultant forward speed of said decoy units simulates that of the space craft it seeks to protect.

6. In a Doppler countermeasure device wherein a decoy missile is launched ahead of a space craft whose protection is sought, and wherein arms are extended at approximate right angles to said missile and wherein wires are reeled from said extended arms to trail therebehind for travel of the decoys thereon, a reel casing, a cable capable of being wound on the casing, a compression spring in said casing for inducing rotation of said reel casing, a detent for holding said reel casing stationary, means operated by the movement of said arms outwardly for removing said detent and reeling said cable from said reel, a centrifugal brake for braking the speed of rotation of said casing, the braking force thus being directly proportional to the speed of rotation of said reel and resiliently mounted guide pulleys for insuring the smooth reeling of said cable from said reel casing.

7. A Doppler countermeasure system comprising a missile body capable of being sent ahead from a target which it is sought to protect, arms pivotally mounted on said missile body, means for extending said arms to a position substantially at right angles to said body and at opposite sides thereof, guide wires capable of being wound on reels in said arms, means for unwinding said wires from said reels, weighted balls on the ends of said guide wires so that said guide wires will extend rearwardly of said missile arms, Doppler decoy units stacked in said arms and threaded on said guide wires, means for dispensing said decoy units in predetermined timed intervals to travel out upon said wires and means for braking the speed of rearward travel of said decoys along said guide wires to simulate the ground speed of the target whose protection is sought.

8. In a Doppler countermeasure system, a missile capable of being projected forward from a vulnerable moving target whose protection is sought, guide wires capable of being reeled from and to trail behind said missile, Doppler decoys stacked within said missile and threaded on said guide wires, antennas on said decoys, dipoles on said antennas of chosen Doppler characteristics, means for ejecting said decoys with their appended antennas out of said missile to travel rearward along said wires, means of braking the speed of rearward travel of said decoys to simulate the ground speed of said vulnerable moving target, and means for causing whirling of said decoys on said guide wires to simulate the Doppler characteristics of said moving target.

9. A Doppler countermeasure device comprising a decoy missile body adapted to be launched from a space craft whose protection is sought, to travel at a speed greater than that of said space craft, arms on said missile body extendable at approximate right angles thereto, a spring-actuated reel mounted in each of said arms, a wire capable of being wound on each of said reels, weighted balls on the ends of said wires whereby said balls are caught in the slip stream of said missile and reel from said reels to trail behind said arms, a multiplicity of decoy units threaded onto each of said wires, means maintaining said threaded decoy units in stored and packed condition in said arms, means for effecting the escape of said decoy units at controlled time intervals for travel backward along said wires at controlled speeds so that the resultant forward speed of said decoy units with reference to the earth simulates that of the space craft it seeks to protect.

10. In a Doppler countermeasure system, a missile capable of being projected forward from a vulnerable moving target which it is sought to protect, guide wires capable of being reeled from and trailed behind said missile, Doppler decoys stacked within said missile and threaded on said guide wires, arranged in sets to simulate said vulnerable moving target and draw enemy fire, and ejection means for sending said decoys out to travel rearward along said wires at predetermined time intervals, braking means operable between said wires and said decoy elements to dampen rearward speed of said decoys to simulate the ground speed of the vulnerable moving target, each of said decoy elements comprising a carriage ring for threading said decoy elements onto one of said guide wires, antennas attached to said ring, dipoles on said antennas for simulating selected Doppler characteristics.

11. In a device according to claim 10, means for producing spiralling motion of said decoy units around said guide wires, said means comprising a sail on the outward end of each antenna, a plurality of guy elements securing said sail to the end of said antenna.

12. In a device according to claim 11, means for stabilizing the spiralling of said antenna and maintaining said sail in a position headed into the relative wind encountered by it, said means comprising a vane attached to and integral with each of said saids, said vane comprising an element extending at a substantial right angle to said sail and of a V-configuration, and attached along a V-shaped cutout portion, extending along the rearward edge of said sail.

13. A device according to claim 12 wherein said V-shaped cutout portion is off-center to provide an angle of yaw to said sail.

14. In a Doppler countermeasure system, a missile, guide wires trailing from said missile, decoy antenna units threaded on said guide wires and adapted to slide thereon and adapted also to be stored in stacked relationship within said missile, ejection means located within said missile for ejection of said decoy units from within said missile and out into the slip stream to slide rearwardly on said guide wires, said ejection means comprising a pair of identical cam wheels rigidly mounted on a common axis parallel to said guide wires, a plurality of crest and trough cam surfaces located on the circumference of each of said wheels, the crest and trough surfaces of one cam wheel being vertically staggered with respect to the trough and cam surfaces on the other of said cam wheels, a pin contacting each of said cam wheels and spring biased toward the troughs of said cam wheels, one of said pins alternately restraining and releasing the rearward unit of said stacked decoy units, means for rotating said cam wheels, a common ram jet means for providing rotary movement for rotating said wheels and for propelling said decoy units out of said missile and into the air stream.

15. In a Doppler countermeasure device comprising a missile and guide wires trailing therefrom, a decoy antenna system for receiving and returning radar signals in a manner to simulate a target it is sought to protect, a storage and ejection system therefor comprising a plurality of decoy units provided with a ring element for threading onto said guide wire and for sliding movement thereon, a brake element for controlling the speed of travel of said decoy unit along said guide wire, a plurality of dipole carrying antennas for receiving and returning radar signals, and vane carrying sails on said antennas for spiralling said antennas around said guide wire, means for urging said decoy rings in stored, threaded and stacked condition rearward, means for restraining said decoy rings, means for releasing the restraint on said rearmost ring while maintaining restraint on the remainder of the stock and means for ejecting said released decoy unit with its attached antenna and sail forcefully into the slip stream of said missile.

16. A Doppler countermeasure missile comprising a missile body, a pair of arms pivoted to said missile body and adapted to be moved to a position at substantial right angles to said missile body, a rear wall on each of said arms, means for removing and jettisoning said rear wall when said arms are moved to right angular position, guide wires wound on reels located in said missile body, decoy units having antennas for receiving and returning radar signals, carriage rings for threading said decoy units onto said guide wires, said antennas provided with vane carrying sails, said antenna units being stored in straightened condition along the length of said arm, said sails and vanes being meshed and stacked in a plurality of stacks along the inner end of said arm, means for restraining said rings in stacked condition within said arms, means for urging the whole stack of rings toward the rear removable wall of said arms, means for removing said restraining means from the rearwardmost single ring element and means for forceably expelling said released decoy unit into the slip stream of said missile.

17. A decoy unit for a Doppler countermeasure system comprising, a carriage ring element threadable and slidable on a guide wire of said system, brake flaps attached to said carriage ring and adapted to provide magnetic braking force with magnetized portions of said guide wire, an antenna member comprised of fiber glass segments, flexible joints connecting said segments to each other, a flexible section attaching one of said segments to said carriage ring, a sail element, a flexible section attaching another of said segments to said sail, a vane of V configuration extending normally from one plane surface of said sail, said sail and vane being capable of nesting with other sails and vanes of like configurations.

18. A Doppler countermeasure system comprising a missile body capable of advancing forward from a target it is sought to protect, arms pivoted to said missile body and capable of moving from a position parallel to said missile body to an extended position and normal thereto, guide wires capable of reeling from said missile body to trail behind said missile body, a plurality of decoy units stored in threaded relationship on said guide wires, each of said arms providing a housing and storage space for said decoy units and for the apparatus for ejection of said units from said housing, a rearward wall on said arm, means for releasing and jettisoning said wall when said arms reach the right angular position, thereby providing an opening for the escapement of said decoy units, and means for ejecting said decoy units from said arms at controlled intervals.

19. In a Doppler countermeasure device, a missile body, hollow arms pivoted to said missile body and capable of moving from a position of parallelism with, to a position normal to said missile body, a plurality of decoy units stored in said arms and capable of operating to simulate the frequency characteristics of a target whose protection is sought, a rear wall on each of said arms, means for removing and jettisoning said rearward wall to provide unimpeded egress of said decoy units, guide wires stored on reels and threaded through said decoy units, means for unreeling said guide wires to trail behind said missile body and means for ejecting said decoys from said arms.

20. A decoy dispenser comprising a missile body for projecting ahead of a moving target whose protection is sought, hollow arms on said missile body, wires capable of reeling from said missile body through said arms to trail behind said missile, weights on the ends of said wires to provide drag, decoy units threaded on said guide wires and stored in said arms, said decoy units comprising antennas capable of operating to simulate the Doppler frequencies of the target whose protection is sought, means to propel said decoys out of said arms to travel rearwardly on said guide wires, timed explosive means located within said weights to remove said weights from the ends of said guide wires, whereby the decoy units are allowed to slide from the ends of said wires.

21. In a Doppler countermeasure system, a guide wire provided with magnetized segments, decoy units threaded on said guide wire and adapted to slide thereon, said decoy unit comprising a slide carriage, brake flaps attached to said carriage for responding to magnetized portions on said wire to dampen rate of travel of said decoy on said wire, fiber antennas secured to said carriage, dipoles electroplated on said antennas for receiving and returning signals of chosen Doppler frequencies, sails on said antennas for causing said antennas to stand outwardly at an angle from and spiral around said guide wire, thus permitting reflection waves of both horizontal and vertical polarization components, and producing randomness in antenna position, and randomness to the phase addition of said dipoles.

22. In a device according to claim 21, vanes on said sails upstanding from the surface of said sails and making a V-configuration at their line of attachment to said sails, said vanes compensating for drag force exerted on said sails and aiding in effecting an equilibrium position of said sails to produce approximately equal horizontal and vertical polarization from the dipoles electroplated on said antennas.

23. In a Doppler countermeasure system comprising a guide wire adapted to trail behind a missile, a decoy unit threaded on said guide wire and adapted to slide thereon, said decoy unit comprising a carriage ring, antennas attached to said carriage ring, a sail foil attached to the outer ends of said antennas to hold said antennas at an angle to said guide wire and produce spiralling motion of said antennas about said guide wires, guy elements attaching said sails to said antennas, the relative lengths of said guy elements being chosen to effect a desired angular position of said sails.

24. A device according to claim 23 wherein a vane is provided for each sail extending substantially normally thereto, and whose attachment line to said sail surface is of V configuration, said vane compensating for drag force on said sail surface and compensating therefor to produce substantially equal horizontal and vertical polarization components.

25. A device for the controlled dispensing of decoy antennas to travel along guide wires provided for the purpose wherein said antennas are threaded onto said guide wire in stacked relationship, means positioned at the rear of the stack for urging the entire stack in a direction toward an ejection position, means for restraining the entire stack, means for withdrawing the restraint from the topmost element of said stack while restraint is maintained on the remaining elements of said stack, air blast force directed on said released antenna elements to propel said antenna elements rearwardly along said guide wire.

26. A device as set forth in claim 25 wherein said restraining and releasing means comprises a pair of cam wheels mounted for rotation on a common axis, crests and troughs of said cam surfaces positioned on the circumferential surface of each of said cam wheels, the troughs and crests of one cam wheel being positioned in alternating relationship to the troughs and crests of the other wheel, reciprocating pins operated by said cam wheels and spring biased into the troughs of said cams, said pins alternating in restraining the entire stack of antennas and releasing the topmost antenna, a ram jet operated turbine mounted concentrically with said cam wheels and operating to rotate said cam wheels.

27. A device for providing equilibrium and lift to a Doppler decoy flexible antenna, said device comprising an antenna member adapted for sliding movement on a guide member, a sail, forward and rear attachment lines securing said sail to said antenna, said rear lines being longer than said forward lines to produce a forward force component greater than the negative tension vector of said sliding antenna.

28. In a device according to claim 27, a vane of assymetric V-shape attached to said sail and integral therewith, said vane extending normally to the surface of said sail and producing a dihedral effect to maintain said sail in equilibrium position and produce spiralling of said antenna about said guide element.

29. The method of storing decoy units in a Doppler countermeasure system wherein decoy units comprising fiber glass antenna sections united by flexible steel joints are secured at one end to a carriage ring and at their other end are attached to sails by flexible wires, and wherein the sails are secured to these flexible wires by means of guy elements, and wherein each sail carries a vane normally directed with reference to one surface only of said sail, and wherein said decoy units are dispensed onto a guide wire trailing from a space craft provided with outwardly extending arms, said method comprising threading said carriage rings onto said guide wire, stacking said carriage rings in threaded condition, restraining the entire stack of carriages, laying each antenna along the length of said arm, folding said antennas as necessary to accommodate the excess length thereof to the length of the arm, storing the sails in stacked relationship in a plurality of adjacently positioned stacks, alternate sails being inverted to allow nesting of the vanes and guy elements of said sails, drawing the flexible attaching wires together to lie in aisles between the stacks of sails.

30. The method of dispensing the stored elements set forth in claim 29 wherein each missile arm includes a jettisonable rear wall, said method comprising, jettisoning the rear wall of the missile arms thereby providing an opening for the escape of the antennas and their appended sails, withdrawing restraint from the topmost carriage ring while maintaining restraint on the remainder of the stack, applying air blast force to cause the released carriage ring and appended antennas to travel rearwardly along the guide wire.

31. The method of dispensing the stored elements according to claim 30 including spiralling the antennas about the guide wires to produce randomness in the receiving and returning of signals.

32. The method of effecting a decoy target for drawing enemy fire from a moving space vehicle whose protection is sought, said method comprising receiving and returning signals from a Doppler seeker to cause simulation of the Doppler frequency characteristics of said space vehicle at a distance therefrom sufficient to prevent radiation damage in the area of said space vehicle in the event the decoy target is hit.

33. The method of simulating Doppler frequency characteristics of a moving space vehicle or other vulnerable target whose protection is sought, and at a distance therefrom, wherein decoy elements of given Doppler characteristics are dispensed from a missile preceding said moving space vehicle and moving at a velocity greater than the velocity of said moving vehicle, said method comprising, causing said decoy elements to travel at the velocity of said moving vehicle, and causing random whirling of said elements to produce reflection waves from an enemy seeker of both horizontal and vertical polarization components.

34. The method of providing Doppler decoy protection for a moving target whose protection is sought, comprising simulating the Doppler characteristics of said moving target at a distance in advance of said target, the simulated characteristics moving at the same rate of speed as said moving target.

* * * * *